US006655628B2

(12) United States Patent
Sturm

(10) Patent No.: US 6,655,628 B2
(45) Date of Patent: Dec. 2, 2003

(54) BOBBIN-WINDING DEVICE FOR A CHEESE-PRODUCING TEXTILE MACHINE

(75) Inventor: Christian Sturm, Krefeld (DE)

(73) Assignee: W. Schlafhorst AG & Co. (DE)

( * ) Notice: Subject to any disclaimer, the term of this patent is extended or adjusted under 35 U.S.C. 154(b) by 102 days.

(21) Appl. No.: 09/803,314

(22) Filed: Mar. 9, 2001

(65) Prior Publication Data

US 2001/0045488 A1 Nov. 29, 2001

(30) Foreign Application Priority Data

Mar. 11, 2000 (DE) ..... 100 12 005

(51) Int. Cl.[7] ..... B65H 54/42

(52) U.S. Cl. ..... 242/486.2; 242/486.4; 242/907

(58) Field of Search ..... 242/131, 485.3, 242/486.2, 486.4, 907

(56) References Cited

U.S. PATENT DOCUMENTS

| | | | | | |
|---|---|---|---|---|---|
| 2,753,125 | A | | 7/1956 | Würmli | |
| 3,241,778 | A | * | 3/1966 | Bourgeas | 242/486.4 |
| 3,883,082 | A | | 5/1975 | Gritschke et al. | |
| 5,112,000 | A | * | 5/1992 | Derichs et al. | 242/486.4 |
| 5,409,173 | A | * | 4/1995 | Fahmuller et al. | 242/486.2 |
| 5,697,565 | A | * | 12/1997 | Zitzen | 242/486.4 |
| 6,135,383 | A | * | 10/2000 | Flamm et al. | 242/477.4 |
| 6,311,919 | B1 | | 11/2001 | Hermanns et al. | |
| 2002/0033430 | A1 | * | 3/2002 | Sturm | 242/486.4 |

FOREIGN PATENT DOCUMENTS

| | | | |
|---|---|---|---|
| CH | 374 003 | | 1/1964 |
| CH | 430 527 | | 8/1967 |
| CH | 516 469 | | 1/1972 |
| DE | AS 1 065 562 | | 9/1959 |
| DE | GM 18 30 734 | | 8/1960 |
| DE | GM 19 73 332 | | 11/1967 |
| DE | OS 2 256 270 | | 5/1974 |
| DE | AS 21 57 304 | | 12/1976 |
| DE | OS 26 06 859 | | 8/1977 |
| DE | 195 34 333 | A1 | 3/1997 |
| DE | 198 58 548 | A1 | 6/2000 |
| GB | 1 349 859 | | 4/1974 |
| JP | 6-57569 | * | 3/1994 |

OTHER PUBLICATIONS

German Search Report.
Japanese Patent Abstract JP 11 286370A, Oct. 19, 1999.

* cited by examiner

*Primary Examiner*—Michael R. Mansen
(74) *Attorney, Agent, or Firm*—Kennedy Covington Lobdell & Hickman, LLP

(57) ABSTRACT

A bobbin-winding device (28) for a cheese-producing textile machine with a pivotably seated creel (18) for holding a cheese (11), and a damping device (29), which can be acted on magnetically and is connected with the creel (18). The damping device (29) has a movable, electrically conductive component (30), which is at least indirectly connected with the creel (18) and is arranged such that the movably seated component (30) intersects the magnetic field of a stationarily arranged magnet system (32), preferably a permanent magnet system, in a contactless manner.

13 Claims, 2 Drawing Sheets

BOBBIN-WINDING DEVICE FOR A CHEESE-PRODUCING TEXTILE MACHINE

CROSS-REFERENCES TO RELATED APPLICATIONS

This application claims the benefit of German patent application 10012005.9 filed Mar. 11, 2000, herein incorporated by reference.

FIELD OF THE INVENTION

The present invention relates to a bobbin-winding device for a cheese-producing textile machine with a pivotably seated creel for holding a cheese, and a damping device connected with the creel and acted on magnetically.

BACKGROUND OF THE INVENTION

With cheese-producing textile machines, for example automatic cheese winders whose bobbin-winding devices operate at winding speeds of up to 2,000 m/min, there is always the danger that strong vibrations of the creels will occur in the process of winding cheeses.

At the start of a bobbin winding operation in particular, as well as in the course of producing very dense cheeses, there is the danger that the amplitude of the creel vibrations becomes so large that the winding process is negatively affected whereby cheeses may be produced which can barely be unwound and are therefore useless. For this reason, the known high-performance bobbin winding machines typically have a device for damping the creel vibrations.

A creel damping device for a bobbin winding machine which has a linearly operating hydraulic damping cylinder is described, for example, in German Patent Publication DE 195 34 333 A1. The damping element in this case is embodied as an oil damper and is connected via a lever to the creel.

Any leakage of the damper oil along the piston rod of these known damping devices is prevented by means of a seal. Since this seal continuously presses against the moving piston rod and therefore causes considerable static friction, a quite large breakaway torque must always be overcome before the damper moves. Since this breakaway torque occurs in both directions, the contact force between the cheese and the yarn guide drum which drives the cheese by means of a frictional connection is not unequivocally defined by the creel compensation means and can therefore not be set accurately.

Moreover, with known oil dampers there is always the danger that damper oil will leak, which leads to soiling of the surroundings, as well as to an impairment of the damping capability, which is not always immediately noticed.

Most of the past attempts to address these problems have proposed to replace these oil dampers by other damping devices. Swiss Letters Patent 374 003, for example, describes a damping device in which a hydraulic damping cylinder is replaced by an electromagnet, which can be charged with current and acts on an armature plate. The armature plate itself is connected via a rod with the creel to be damped. Thus, with this known damping device a force component is generated by means of an electromagnet, which presses the armature plate connected with the creel against a stationary abutment. Accordingly, the damping action of this damping device results from the mechanical friction between the armature plate and the abutment.

Since the damping device in accordance with Swiss Letters Patent 374 003 also has several grave disadvantages, this known damping device was also never able to gain acceptance in actual practice.

The damping device in accordance with Swiss Letters Patent 374 003 also necessitated a relatively large breakaway torque upon every actuation for displacing the armature plate in relation to the electromagnet, so that a defined creel compensation was hardly possible. Moreover, the wear which occurs in connection with this device is not inconsiderable, because the components performing the damping function are in mechanical contact.

OBJECT AND SUMMARY OF THE INVENTION

In view of the above mentioned prior art, it is an object of the present invention to provide a damping device for the creels of high-performance textile machines which avoids the disadvantages of the known damping devices.

In accordance with the present invention, this object is addressed by a bobbin-winding device for a cheese-producing textile machine comprising a pivotably seated creel for holding a cheese, a damping device connected with the creel, and a stationarily arranged magnet system for generating a magnetic field. In accordance with the invention, the damping device has a movable electrically-conductive component at least indirectly connected with the creel and arranged to intersect the magnetic field of the stationarily arranged magnet system in a contactless manner.

More specifically, the movable electrically-conductive component preferably is embodied as a rotatable non-ferromagnetic damper disk an edge area of which is orthogonally penetrated by the magnetic field of the magnet system and therefore reacts almost free of hysteresis but also has the particular advantage of being almost free of wear since it operates in accordance with the so-called eddy current principle. That is, free electrons in the material of the disk in the range of the magnetic field of the magnet system are radially accelerated in the course of the appropriate rotation of the damper disk at an increased angular velocity, so that a circular current is generated in the disk plane.

This circular current generates a magnetic field, which enters into a reciprocal action with the magnetic field of the magnet system which penetrates through the disk. The torque created in the course of this action is proportional to the angular velocity, and its direction is always opposite the direction of movement of the damper disk. Thus, a contactless braking torque is generated by the eddy currents at the damper disk and is transmitted to the creel, where it automatically results in the effective damping of the occurring vibrations.

In a preferred embodiment, the magnet system is embodied as a permanent magnet system, because a device designed in this manner does not require any external energy supply.

Since the braking torque which can be achieved is not a function of the velocity with which the damping disk is moved through the magnetic field of the magnet system, the damping disk is furthermore connected to the creel by means of a gear mechanism. The gear mechanism provides the transmission of the angular velocity of the creel, so that the damper disk moves through the applied magnetic field at an angular velocity which clearly lies above the corresponding angular velocity of the creel.

Preferably, the damping disk is either made of aluminum or of copper. Both materials have a high degree of electric conductivity and therefore favor the generation of eddy currents.

In a preferred embodiment, the gear mechanism is embodied as an interlocking gear mechanism, preferably as a toothed gear mechanism, and has at least one gear wheel which is connected with the pivot shaft of the creel in a manner fixed against relative rotation, as well as a second gear wheel which is arranged on the damping disk also in a manner fixed against relative rotation. The gear wheels which mesh with each other transmit the vibration occurring in the area of the creel during winding operations with almost no delay to the damper disk, and also immediately return the braking torque initiated at the damping disk to the creel.

The gear ratio of the gear mechanism preferably lies between 3:1 and 10:1, optimally about 6:1. The angular velocity of vibrations, which can occur during the winding process at the creel, is transferred at a corresponding amplification to the damping disk by means of this gear ratio and thereby generates a corresponding, oppositely directed torque which is proportional to the angular velocity of the damper disk. This damping torque is transmitted back to the creel via the gear mechanism and in the process is again amplified by the gear ratio factor of the gear mechanism. Thus, the gear ratio factor of the gear mechanism is effectively squared into the damping constant.

In order to always create a transmission gear which is almost free of play, it is preferred that the damping disk, or the gear wheel, which is arranged fixed against relative rotation on the damping disk, is rotatably seated via a bearing shaft on a rocker, on which a spring element acts such that the gear wheels of the gear mechanism are radially pushed against each other and therefore always mesh with each other free of play. In this manner, it is assured that it is possible to also transmit and dependably dampen creel vibrations of relatively low amplitudes.

In a preferred embodiment form, the creel is supported in a stationary console and is rotatable to a limited degree.

The permanent magnet system is preferably constructed in a U-shape and consists, for example, of a cuboid permanent magnet, as well as two laterally adjoining yoke elements made of a ferromagnetic material. The edge area of the damper disk moves in a contactless manner between these two yokes, which results in good bundling of the magnetic field of the permanent magnet.

In an alternative embodiment, the permanent magnet system can also have several permanent magnets whose polarization are respectively arranged such that the magnetic flux is conducted several times in different directions through the damping disk.

The spacing of the yokes from each other is preferably matched to the thickness of the damper disk and is selected such that as narrow as possible an air gap is formed between each of the yokes and the damping disk.

Further details of the invention will be understood from an exemplary embodiment described below and illustrated in the accompanying drawings.

DETAILED DESCRIPTION OF THE PREFERRED EMBODIMENT

Figure 1:
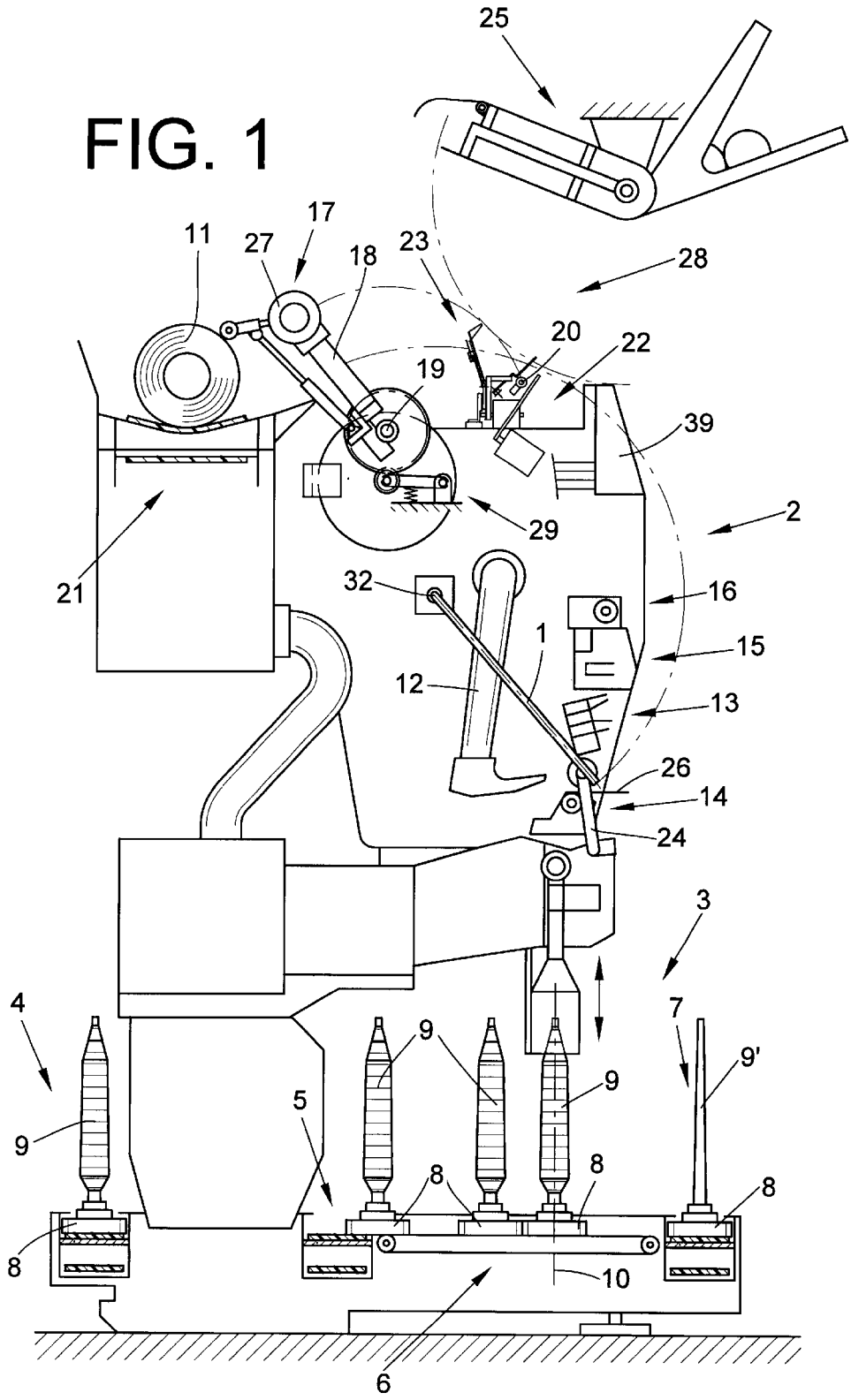
FIG. 1 is a lateral view of a winding head of a cheese-producing textile machine with a damping device in accordance with the present invention in the area of the creel.

Referring now to the accompanying drawings, a work station 2 of a cheese-producing textile machine, in the exemplary embodiment a bobbin winding machine, is schematically represented in FIG. 1 in a lateral view. Such bobbin-winding machines customarily have a plurality of identical work stations between their end frames, in the present case winding heads 2.

Spinning cops 9 produced on a ring-spinning machine (not represented) are rewound into large-volume cheeses 11 at these winding heads in a known manner, and therefore not explained in detail.

During the winding process, the cheeses 11 are held in a pivotably seated creel 18. When completed, the cheeses 11 are transferred by means of an appropriate pivoting of the creel 18 around a pivot shaft 19 to a cheese transporting installation 21, which is preferably arranged behind the bobbin-winding devices 28 of the work stations 2. The cheeses 11 are transported by means of the cheese transport installation 21 to a bobbin loading station or the like (also not represented) arranged at the end of the textile machine.

As a rule such winding machines, also called automatic cheese winders, in addition have a logistic installation in the form of a bobbin and tube transport system 3. Spinning cops 9, or empty tubes 9', positioned in a vertical orientation, circulate on transport plates 8 in this bobbin and tube transport system 3. Only the cop delivery track 4, extending over the length of the machine, the reversible storage track 5 extending behind the winding heads 2, a transverse transport track 6, and a tube return track 7 of this bobbin and tube transport system 3 which as a whole is relatively extensive, are represented in FIG. 1.

The spinning cops 9 delivered over the cop delivery track 4 are rewound into large-volume cheeses 11 in the unwinding positions 10, each of which is located in the area of the transverse transport tracks 6 at the winding heads 2.

As is known per se and therefore only briefly explained, the individual work stations have various devices which assure the proper operation of these work stations 2. By way of example, in FIG. 1, a suction nozzle is indicated by 12, a gripper tube by 24, a splicing device by 13, a yarn tensioning device by 14, a yarn cleaner with a yarn cutting device by 15, and a paraffin application device by 16. Moreover, each winding head 2 is equipped with a precisely controllable suction tube 1, as well with a storage plate 26, arranged in the area of the yarn tensioner 14.

The bobbin-winding device 28 has a bobbin drive mechanism 17 which, in accordance with the present exemplary embodiment, is integrated into a bearing housing at the creel 18.

Figure 2:
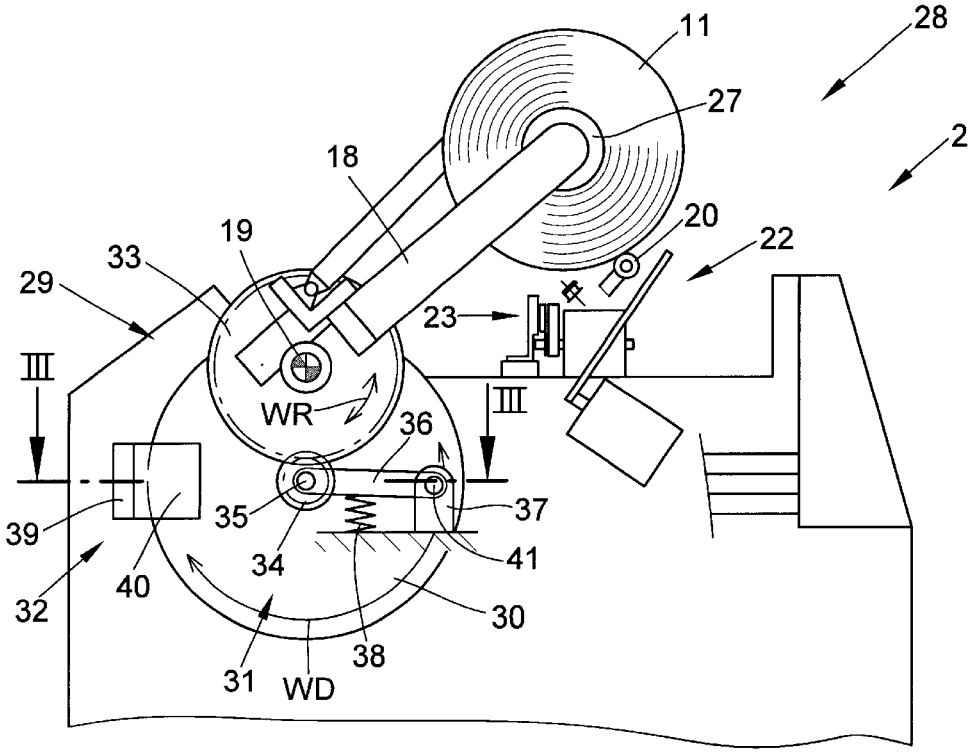
FIG. 2 represents the bobbin-winding device with the creel and the associated damping device of FIG. 1 on an enlarged scale.
Figure 3:
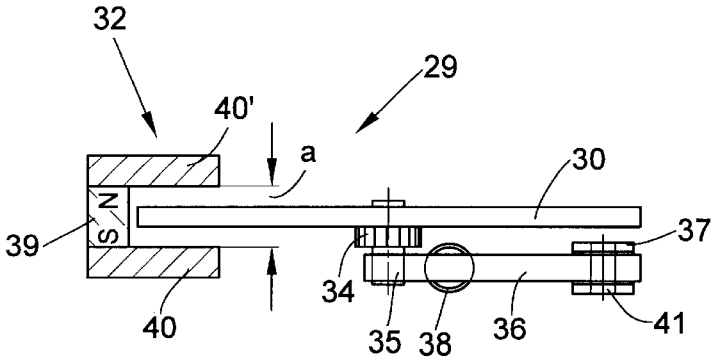
FIG. 3 is a top plan view of the damping device in accordance with the present invention as viewed along section line III—III in FIG. 2.

As indicated in FIG. 2, the cheese 11 is held in tube receiving plates 27 of the creel 18 during the winding process, and rests with its surface on a support roller 20. In the course of this operation, the support roller 20 is rotated by the driven cheese 11 by means of a frictional connection. A yarn traversing device 22, which is described in detail in German Patent Publication DE 198 58 548 A1, for example, is installed in the area of the support roller 20.

Furthermore, the individual winding heads 2 each have a clamping and cutting device 23, which can be precisely controlled, in the area of their support rollers 20.

As a rule, the individual winding heads 2 furthermore have an empty tube storage device as a part of the winding head which, as for example is known from German Patent Publication DE 21 57 304 B, and can be acted upon by the creel 18 for removing an empty tube.

As can be seen in FIG. 2 in particular, a damping device 29 is arranged at the creel 18 of each bobbin-winding device 28 of the automatic cheese winder. In accordance with the present exemplary embodiment, each one of these damping devices 29 is basically comprised of a damping disk 30, which is connected by means of a gear mechanism 31 with the creel 18, as well as a permanent magnet system 32.

The gear mechanism 31, whose gear ratio i is between approximately 3:1 and 10:1, preferably about 6:1, has a relatively large gear wheel 33, which is connected with the pivot shaft 19 of the creel 18 in a manner fixed against rotation relative thereto, and it furthermore has a comparatively small gear wheel 34, which is connected to the damper disk 30 in a manner fixed against rotation relative thereto.

The gear wheel 34 and the damping disk 30 are rotatably arranged via a bearing shaft 35 on a rocker 36, which in turn is fixed to be pivotably movable by means of a shaft 41 on a stationary console 37. The rocker 36 is acted upon by a spring element 38 such that the gear wheels 33, 34 are radially pushed against each other.

The permanent magnet system 32 preferably has a cuboid permanent magnet 39, which has the polarization represented in FIG. 2, for example, as well as two laterally arranged ferromagnetic yoke elements 40, 40'. The damper disk 30 can rotate in a contactless manner between the yokes 40, 40'. In this case the yokes 40, 40' are at a selected distance a from each other, which is slightly larger than the thickness d of the damper disk.

The operation of the device of the present invention may thus be understood. If vibrations of the creel 18 occur in the course of the winding process, they are transmitted without delay via the gear mechanism 31 to the damper disk 30. Thus, by means of the interposed gear mechanism 31, whose gear ratio i preferably is 6:1, creel vibrations of an angular velocity WR, are transmitted at an amplification of six-fold to the damper disk 30, so that the angular velocity WD of the damper disk 30 correspondingly is clearly greater than the angular velocity WR of the creel 18.

In the course of the rotation of the damper disk 30, the edge area of the damper disk intersects the magnetic field of a stationary permanent magnet system 32 and a circular current is created in the area of the disk plane, as already described above, whose magnetic field enters into a reciprocal action with the magnetic field of the stationary permanent magnet system 32, i.e. eddy currents appear.

These eddy currents are particularly distinctive if the damper disk 30 is made of a material with good electrical conducting capabilities, such as aluminum or copper. The torque being created because of the eddy currents attempts to fix the damper disk 30 on the stationary permanent magnet system 32, i.e. a braking torque acts on the damper disk 30, which is proportional to the angular velocity and always opposite the direction of movement of the damper disk 30.

This braking torque acting on the damper disk 30 is amplified via the gear mechanism 31 by the gear ratio factor i of the gear mechanism, is transmitted to the creel 18, and effectively suppresses the vibrations occurring in this area. As can be seen from the above explanations, the gear ratio i of the gear mechanism 31 is always entered squared into the damping constant.

The invention is not limited to the exemplary embodiment represented. Further exemplary embodiments are easily conceivable within the scope of the present invention. For example, the gear mechanism 31 need not absolutely be embodied as a single stage toothed gear mechanism. It is easily possible to provide a multi-stage toothed gear mechanism, or to employ a comparable interlocking gear mechanism is place of a toothed gear mechanism. The use of a frictionally connected gear mechanism is also possible without the functional ability of the device being thereby degraded. It is moreover not absolutely necessary to arrange the damper disk 30, as well as the associated gear wheel 35, on a spring-loaded rocker 36. Hereagain, comparable alternative embodiments are possible.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A bobbin-winding device for a cheese-producing textile machine comprising a pivotably seated creel for holding a cheese, a damping device connected with the creel, and a stationarily arranged magnet system for generating a magnetic field comprising at least one permanent magnet, the damping device having a movable electrically-conductive component at least indirectly connected with the creel and arranged to intersect the magnetic field of the stationarily arranged magnet system in a contactless manner.

2. The bobbin-winding device in accordance with claim 1, characterized in that the electrically-conductive component is a rotatably seated damper disk connected via a gear mechanism with the creel.

3. The bobbin-winding device in accordance with claim 2, characterized in that the damper disk is made of aluminum.

4. The bobbin-winding device in accordance with claim 2, characterized in that the damper disk is made of copper.

5. The bobbin-winding device in accordance with claim 2, characterized in that the gear mechanism comprises an interlocking gear.

6. The bobbin-winding device in accordance with claim 2, characterized in that the gear mechanism comprises an interlocking gear mechanism.

7. The bobbin-winding device in accordance with claim 6, characterized in that the gear mechanism comprises a gear wheel connected with a pivot shaft of the creel in a manner fixed against rotation relative thereto, and a second gear wheel fastened on the damper disk in a manner fixed against rotation relative thereto.

8. The bobbin-winding device in accordance with claim 7, characterized in that the damper disk and the second gear wheel connected therewith are rotatably hinged to a rocker on which a spring element acts.

9. The bobbin-winding device in accordance with claim 8, characterized in that the rocker is pivotably movable around a shaft and is seated on a stationary console.

10. The bobbin-winding device in accordance with claim 8, characterized in that the electrically-conductive component is a rotatably seated damper disk and the stationarily arranged magnet system is a permanent magnet system having yokes spaced by a distance which is slightly greater than a thickness of the damper disk.

11. The bobbin-winding device in accordance with claim 6, characterized in that the gear mechanism has a rear ratio between approximately 3:1 and 10:1.

12. The bobbin-winding device in accordance with claim 6, characterized in that the gear mechanism has a ear ratio of approximately 6:1.

13. The bobbin-winding device in accordance with claim 1, characterized in that the permanent magnet system is designed in a U-shape and has at least one cuboid permanent magnet and lateral ferromagnetic yokes.

* * * * *